US007121185B2

(12) United States Patent
Alrefai

(10) Patent No.: US 7,121,185 B2
(45) Date of Patent: Oct. 17, 2006

(54) HYDRAULIC CYLINDER HAVING A SNUBBING VALVE

(75) Inventor: Mahd H. Alrefai, Orland Park, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/855,575

(22) Filed: May 28, 2004

(65) Prior Publication Data

US 2005/0263001 A1 Dec. 1, 2005

(51) Int. Cl.
*F15B 15/22* (2006.01)
*F15B 15/28* (2006.01)

(52) U.S. Cl. ..... 91/1; 91/407; 92/5 R

(58) Field of Classification Search ..... 91/1, 91/394, 395, 407, 392, 393, 396–406, 408–410; 92/5 R, 85 B
See application file for complete search history.

(56) References Cited

U.S. PATENT DOCUMENTS

| | | | | | |
|---|---|---|---|---|---|
| 614,259 | A | | 11/1898 | Bouldry | |
| 3,160,836 | A | | 12/1964 | Farley | |
| 3,704,650 | A | * | 12/1972 | Berg | 91/395 |
| 3,898,555 | A | | 8/1975 | Tellerman | |
| 3,915,070 | A | | 10/1975 | Mailliet | |
| 3,998,132 | A | * | 12/1976 | Rasigade | 91/395 |
| 4,033,235 | A | | 7/1977 | Berg | |
| 4,121,504 | A | | 10/1978 | Nowak | |
| 4,179,982 | A | | 12/1979 | Saotome | |
| 4,288,793 | A | * | 9/1981 | Lotscher | 340/870.37 |
| 4,356,738 | A | | 11/1982 | Shuler et al. | |
| 4,424,737 | A | * | 1/1984 | Endo | 91/396 |
| 4,552,055 | A | | 11/1985 | Foxwell | |
| 4,632,018 | A | | 12/1986 | Lymburner | |
| 4,718,647 | A | | 1/1988 | Ludwig | |
| 4,771,866 | A | | 9/1988 | Heideman et al. | |
| 4,783,043 | A | | 11/1988 | Koerber | |
| 4,788,489 | A | | 11/1988 | Kobayashi et al. | |
| 4,883,150 | A | | 11/1989 | Arai | |
| 4,899,643 | A | | 2/1990 | Hvilsted et al. | |
| 4,901,628 | A | * | 2/1990 | Krage | 92/5 R |
| 4,952,873 | A | | 8/1990 | Tellerman | |
| 4,961,055 | A | | 10/1990 | Habib et al. | |
| 5,103,172 | A | | 4/1992 | Stoll | |
| 5,150,049 | A | | 9/1992 | Schuetz | |

(Continued)

FOREIGN PATENT DOCUMENTS

DE 2313215 6/1974

(Continued)

OTHER PUBLICATIONS

Patent Abstract of Japan, Abstract of Publication No. 05-018406, published Jan. 26, 1993 (2 pages).

(Continued)

*Primary Examiner*—Igor Kershteyn
(74) *Attorney, Agent, or Firm*—Finnegan, Henderson, Farabow, Garrett & Dunner

(57) ABSTRACT

A hydraulic cylinder has a tube with a first end and a section end. The hydraulic cylinder also has a piston assembly movably disposed within the tube and configured to move between the first and second ends of the tube. The hydraulic cylinder further has a valve plunger connected to the piston assembly and having an axial bore. The hydraulic cylinder additionally has a cap assembly connected to the tube to close off the first end of the tube. The cap assembly has a fluid passageway and the valve plunger is configured to progressively restrict fluid flow through the fluid passageway as the piston assembly approaches the first end of the tube.

26 Claims, 3 Drawing Sheets

U.S. PATENT DOCUMENTS

| | | | | |
|---|---|---|---|---|
| 5,182,980 | A | 2/1993 | Greer | |
| 5,198,761 | A | 3/1993 | Hashimoto et al. | |
| 5,320,325 | A | 6/1994 | Young et al. | |
| 5,509,513 | A | 4/1996 | Kiesel | |
| 5,514,961 | A | 5/1996 | Stoll et al. | |
| 5,517,898 | A * | 5/1996 | Kim et al. | 91/24 |
| 5,546,847 | A | 8/1996 | Rector et al. | |
| 5,583,433 | A | 12/1996 | Sawa | |
| 5,717,330 | A | 2/1998 | Moreau et al. | |
| 5,720,368 | A | 2/1998 | Richardson | |
| 5,815,091 | A | 9/1998 | Dames et al. | |
| 5,952,823 | A | 9/1999 | Nyce et al. | |
| 5,977,778 | A | 11/1999 | Chan et al. | |
| 5,998,992 | A | 12/1999 | Arai | |
| 6,250,612 | B1 | 6/2001 | Doll | |
| 6,356,071 | B1 | 3/2002 | Koski et al. | |
| 6,386,088 | B1 * | 5/2002 | Yoshimoto et al. | 91/395 |
| 6,509,733 | B1 | 1/2003 | Blubaugh et al. | |
| 6,528,990 | B1 | 3/2003 | Nyce | |
| 2002/0074994 | A1 | 6/2002 | Dietz et al. | |
| 2002/0135359 | A1 | 9/2002 | Steinich | |

FOREIGN PATENT DOCUMENTS

| | | |
|---|---|---|
| DE | G91 09 026.1 | 10/1991 |
| DE | 100 44 984 | 3/2002 |
| EP | 1081390 A2 | 3/2001 |
| GB | 2021770 | 12/1979 |

OTHER PUBLICATIONS

Patent Abstract of Japan, Abstract of Publication No. 58-225206, published Dec. 27, 1983 (2 pages).

Patent Abstract of Japan, Abstract of Publication No. 63-067411, published Mar. 26, 1988 (2 pages).

Balluff, "Micropulse—Linear Position Transducers," 2002 Catalog, www.balloff.com/micropulse/micropulsecatalog2002/ BTL_2002_catalog.pdf, printed Jun. 13, 2003 (114 pages).

MTS Sensors Group, "The Magnetostriktive Position Sensors, Temposonics M-Series Rod Model MH", publication date unknown (8 pages).

MTS, "Temposonics, Linear Position Sensors, Product Specifications", publication date unknown (158 pages).

MTS, "Temposonics, Absolute Non-Contacting Position Sensors," Application Guide, 1998 (8 pages).

Hydro-Line, Inc., HLT-II, The Newest Generation Hydr-Line Magnetostrictive Linear Positioning Sensing Transducer, 1996 (1 page).

MTS, "Temposonics LK Embeddable Sensors, OEM Integrator's Manual", 1998 (11 pages).

MTS, "Temposonics L Series LD, Product Specifications", 1999 (8 pages).

MTS, "Temposonics III and L Series Position Sensors, Product Line Overview", 1996 (20 pages).

MTS, "Temposonics L Series LD, Product Specifications", 1998 (12 pages).

Attachment 1, MTS Performance Capabilities, 1998 (4 pages).

Attachment 2, Photo of Sensor, date unknown (1 page).

Attachment 3, Photo of Temposonics Sensor in a Cylinder, date unknown (1 page).

Attachment 4, Photo of Sensor Connector , date unknown (1 page).

MTS, The Magnetostriktive Position Sensors Temposonics M-Series, Rod Model MH, 2002 (8 pages).

* cited by examiner

HYDRAULIC CYLINDER HAVING A SNUBBING VALVE

TECHNICAL FIELD

The present disclosure relates generally to a hydraulic cylinder, and more particularly, to a hydraulic cylinder having a snubbing valve.

BACKGROUND

Work machines such as, for example, dozers, loaders, excavators, motor graders, and other types of heavy machinery use linkage systems to accomplish a variety of tasks. These linkage systems often include hydraulic cylinders. Problems can be encountered in the operation of a hydraulic cylinder if a piston within the hydraulic cylinder impacts against an end structure of the hydraulic cylinder. Such impacts can disturb work operations, cause undesirable noise, and can cause damage to the cylinder or other components of the linkage system. To prevent such problems, a variety of sensors and electro-hydraulic devices are used to cushion the end of a piston stroke within the cylinder. These cushioning devices can include cylinder position sensors that are in communication with electronically actuated hydraulic valves.

For example, U.S. Pat. No. 6,509,733 (the '733 patent) issued to Blugaugh et al. on Jan. 21, 2003, describes a fluid cylinder having an embedded positioning sensor. The fluid cylinder includes a cylinder body having an internal cavity, a piston and rod assembly disposed within the internal cavity, and end caps enclosing the internal cavity. A sensor is disposed within an end cap for sensing a distance of the piston or rod from a predetermined location and outputting signals representative of the distance. This distance information may then be used to manipulate electronically actuated hydraulic valves that control both the position and speed of the fluid cylinder.

Although the fluid cylinder system of the '733 patent may provide position and velocity information for controlling electronically actuated hydraulic valves to prevent piston-to-cylinder impact, the fluid cylinder system may be unable to provide piston-to-cylinder impact protection in the case of a malfunction of components of the system that includes the electronically actuated hydraulic valves. In addition, the positioning sensor of the '733 patent may not assist in avoiding piston-to-cylinder impact in hydraulic systems that do not utilize electronically actuated hydraulic valves.

The disclosed hydraulic cylinder is directed to overcoming one or more of the problems set forth above.

SUMMARY OF THE INVENTION

In one aspect, the present disclosure is directed to a hydraulic cylinder. The hydraulic cylinder includes a tube with a first end and a second end. The hydraulic cylinder also includes a piston assembly movably disposed within the tube and configured to move between the first end and the second end of the tube. The hydraulic cylinder further includes a valve plunger connected to the piston assembly and having an axial bore. The hydraulic cylinder additionally includes a cap assembly connected to the first end of the tube to close off the first end of the tube. The cap assembly has a fluid passageway and the valve plunger is configured to progressively restrict fluid flow through the fluid passageway as the piston assembly approaches the first end of the tube.

In another aspect, the present disclosure is directed to a method of operating a hydraulic cylinder. The method includes moving a piston assembly within a tube between first and second positions. The method also includes progressively restricting a flow of fluid through a fluid passageway in a cap assembly connected to the tube with a valve plunger as the piston assembly nears the first position. The valve plunger is connected to the piston assembly and has an axial bore.

DETAILED DESCRIPTION

Figure 1:
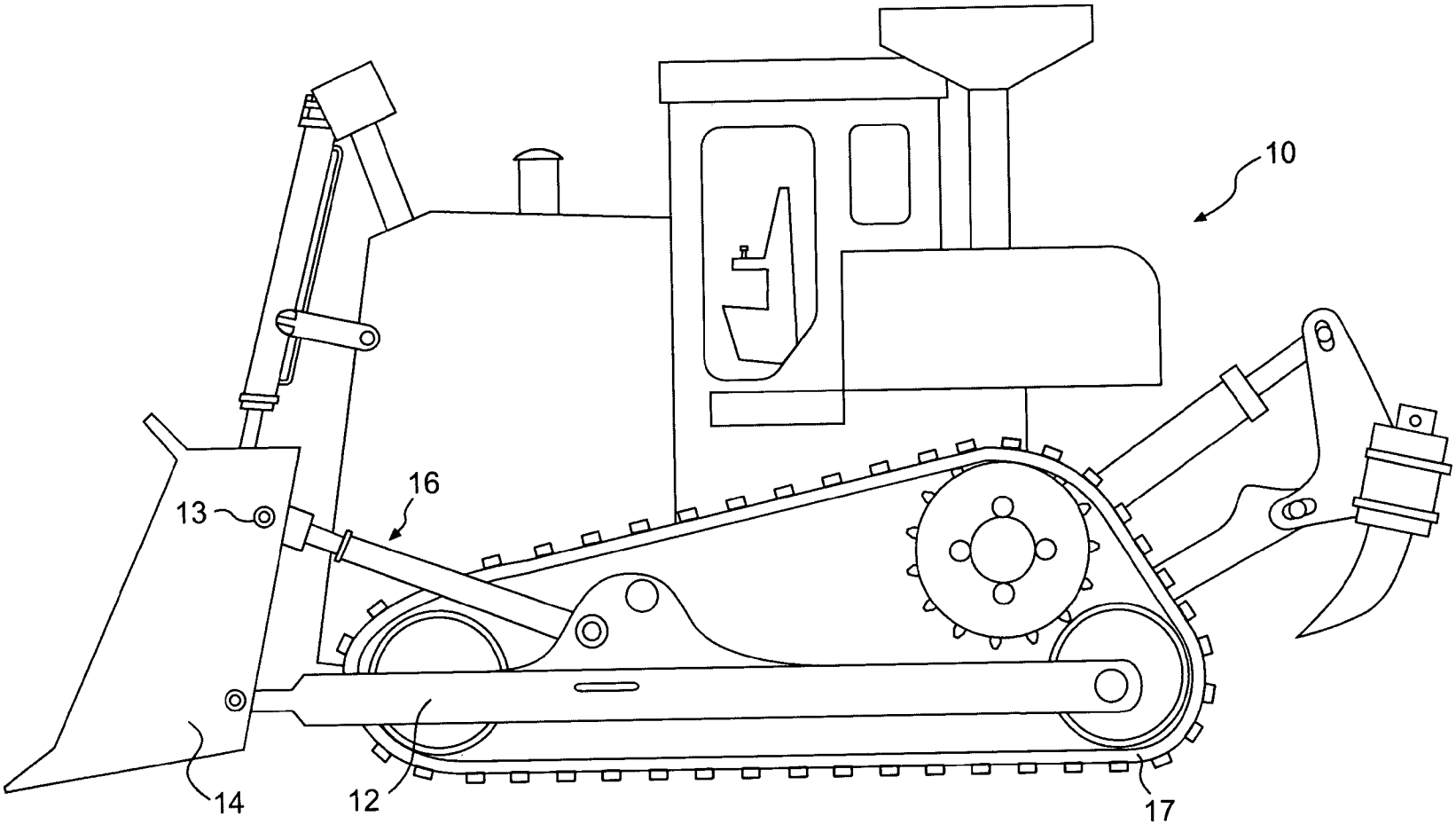
FIG. 1 is a side-view diagrammatic illustration of a work machine according to an exemplary disclosed embodiment.

FIG. 1 illustrates an exemplary work machine 10. Work machine 10 may be a fixed or mobile machine that performs some type of operation associated with an industry such as mining, construction, farming, or any other industry known in the art. For example, work machine 10 may be an earth moving machine such as a dozer, a loader, a backhoe, an excavator, a motor grader, a dump truck, or any other earth moving machine. Work machine 10 may also include a generator set, a pump, a marine vessel, an aircraft, or any other suitable operation-performing work machine. Work machine 10 may include a frame 12, at least one work implement 14, and at least one hydraulic cylinder 16 connecting work implement 14 to frame 12.

Frame 12 may include any structural unit that supports movement of work machine 10. Frame 12 may be, for example, a stationary base frame connecting a power source (not shown) to a traction device 17, a movable frame member of a linkage system, or any other frame known in the art.

Work implement 14 may include any device used in the performance of a task. For example, work implement 14 may include a blade, a bucket, a shovel, a ripper, a dump bed, a propelling device, or any other task-performing device known in the art. Work implement 14 may be connected to frame 12 via a direct pivot 13, via a linkage system with hydraulic cylinder 16 forming one member in the linkage system, or in any other appropriate manner. Work implement 14 may be configured to pivot, rotate, slide, swing, or move relative to frame 12 in any other manner known in the art.

Figure 2:
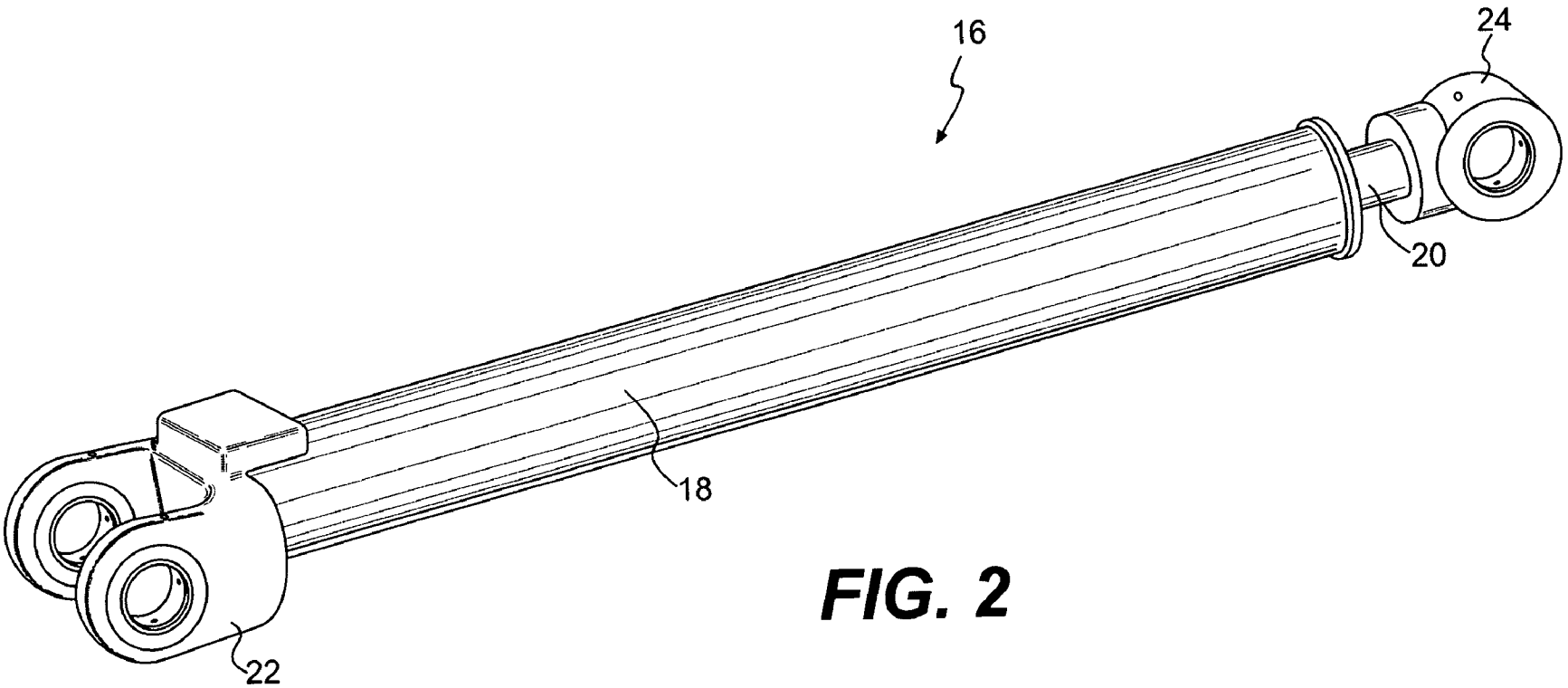
FIG. 2 is a perspective view of a hydraulic cylinder according to an exemplary disclosed embodiment.

As illustrated in FIG. 2, hydraulic cylinder 16 may include a tube 18, a piston assembly 20 disposed within tube 18, a cap assembly 22 operably connected to tube 18, and an eye member 24 fixedly connected to piston assembly 20. One of eye member 24 and cap assembly 22 may be pivotally connected to frame 12, while the other of eye member 24 and cap assembly 22 may be pivotally connected to work implement 14. It is contemplated that eye member 24 and/or cap assembly 22 may alternately be fixedly connected to either frame 12 or work implement 14. Hydraulic cylinder 16 may be supplied with a pressurized fluid to cause piston assembly 20 to displace within tube 18 to increase the effective length of hydraulic cylinder 16. Hydraulic cylinder 16 may also be connected to a fluid drain to cause piston assembly 20 to displace within tube 18 to decrease the effective length of hydraulic cylinder 16. The expansion and retraction of hydraulic cylinder 16 may function to assist in moving work implement 14.

Figure 3:
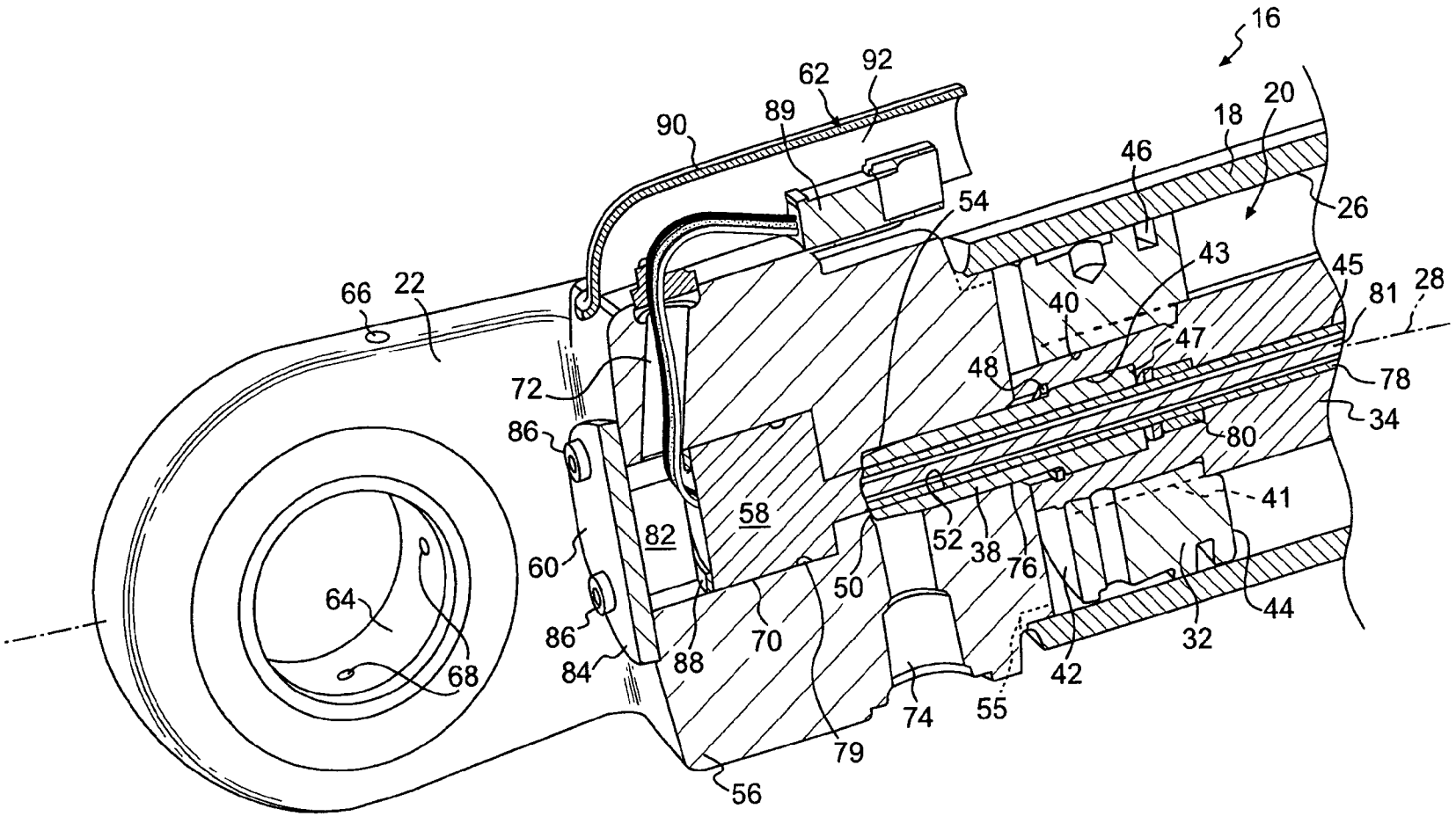
FIG. 3 is a partial cross-sectional and diagrammatic illustration of the hydraulic cylinder of FIG. 2.

FIG. 3 illustrates tube 18 of hydraulic cylinder 16 having a cylindrical internal cavity 26. It is also contemplated that tube 18 may be another shape other than cylindrical such as, for example, a tube having a square cross-section, a rectangular cross-section, a triangular cross-section, or any other shape known in the art. It is also contemplated that internal cavity 26 may likewise have a shape other than cylindrical. Internal cavity 26 may have a longitudinal axis 28 extending therethrough.

Piston assembly 20 may include a first end axially aligned with and disposed within tube 18 and a second end connected to eye member 24 (referring to FIG. 2). Piston assembly 20 may include a piston 32 located towards a first end of piston assembly 20, a piston rod 34, and a valve plunger 38.

Piston 32 may be a cylindrical member having an axial bore 40 with internal threads 41. Piston 32 may include a first hydraulic surface 42 and a second hydraulic surface 44 opposite first hydraulic surface 42. An imbalance of fluid pressure on first and second hydraulic surfaces 42, 44 may cause piston assembly 20 to axially move within tube 18. For example, a fluid pressure on first hydraulic surface 42 being greater than a fluid pressure on second hydraulic surface 44 may cause piston assembly 20 to displace to increase the effective length of hydraulic cylinder 16. Similarly, when a fluid pressure on second hydraulic surface 44 is greater than a fluid pressure on first hydraulic surface 42, piston assembly 20 will retract within tube 18 to decrease the effective length of hydraulic cylinder 16. Piston 32 may include an annular groove 46 disposed within an outer cylindrical surface between the first and second hydraulic surfaces 42, 44. A sealing member (not shown), such as an o-ring, may be disposed within groove 46 to restrict a flow of fluid between the wall of internal cavity 26 and the outer cylindrical surface of piston 32.

Piston rod 34 may be removably connected to piston 32. For example, piston rod 34 may include external threads configured to engage internal threads of piston 32. Alternately, piston 32 may include a through hole configured to slidably receive piston rod 34 and one or more fastening nuts having internal threads configured to engage external threads of piston rod 34 thereby securing piston 32 to piston rod 34. It is contemplated that piston 32 may alternately be fixedly connected to piston rod 34 such as, for example, by welding. It is further contemplated that piston 32 and piston rod 34 may be a single integral part. Piston rod 34 may include an axial bore 45 and a counter bore 43.

Valve plunger 38 may include a first end 47 disposed within counter bore 43 of piston 32 and fixedly connected to piston rod 34. For example, first end 47 of valve plunger 38 may be held against piston rod 34 by a snap-ring 48. Specifically, snap-ring 48 may be disposed within a groove within counter bore 43 and configured to press against a shoulder of valve plunger 38. Alternately, first end 47 of valve plunger 38 may be welded to piston rod 34, may include external threads configured to engage internal threads within counter bore 43 of piston rod 34, or may be connected to piston rod 34 in any other manner known in the art. It is contemplated that valve plunger 38 and piston rod 34 may be a single integral part. It is further contemplated that valve plunger 38 may alternately be connected to piston 32 instead of piston rod 34. Valve plunger 38 may include an axial bore 52 extending from first end 47 through a second end 50 and aligning with axial bore 45 of piston rod 34. Valve plunger 38 may also include an outer tapered portion 54 extending towards second end 50.

Cap assembly 22 may be removably connected to tube 18. For example, cap assembly 22 may include external threads 55 configured to engage internal threads of tube 18. Cap assembly 22 may alternately include internal threads configured to engage external threads of tube 18, may be connected to tube 18 via one or more fasteners, or may be connected to tube 18 in any other manner known in the art. Cap assembly 22 may include a body 56, a sensor 58, a cap member 60, and a connector guard 62.

Body 56 may include one or more bushings 64 configured to slidably and/or pivotally engage either frame 12 or work implement 14. One or more fluid passageways (not shown) may connect a lubrication inlet port 66 to one or more lubrication outlet ports 68 within bushings 64. A lubricating fluid (not shown) may be provided to the body fluid passageways via inlet port 66 such that a lubricating film exists between bushing 64 and an engagement member (not shown) of either frame 12 or work implement 14 during operation of hydraulic cylinder 16. Body 56 may also include a central bore 70 configured to receive sensor 58, a passageway 72 configured to house a wire harness portion of sensor 58, a fluid port 74, and a passageway 76 configured to receive valve plunger 38.

Sensor 58 may be disposed within central bore 70 and may include a sealing member (not shown) disposed within a groove 79 to restrict fluid flow between central bore 70 and sensor 58. Sensor 58 may be a magnetostrictive-type sensor that includes a pressure pipe 78 extending axially into and through bore 52 of valve plunger 38 and into at least a portion of axial bore 45 of piston rod 34. Pressure pipe 78 may contain a magnetostrictive element or wave guide 81 that interacts with an annular magnet 80 mounted in axial bore 45. Annular magnet may be connected to piston assembly 20 at various locations.

The wave guide may include a wire connected to sensor 58 and extending through pressure pipe 78. Sensor 58 may be operable to generate current pulses, which are sent through the wire. Annular magnet 80 may extend around pressure pipe 78 and may produce a magnetic field, which interacts with the current pulse causing a torsional pulse in the wave guide. The torsional pulse is transmitted as a torsional strain wave that has a time period and is reflected back to sensor 58. The torsional strain wave may be compared to the time of launch of the current pulse causing the torsional strain wave to determine the distance to annular magnet 80 from sensor 58.

Cap member 60 may include one or more protrusions 82 extending from a plate member 84. Protrusions 82 may be configured to position sensor 58 within body 56 as plate member 84 is connected to body 56 by one or more fasteners 86. Protrusions 82 may be separated from position sensor 58 by a resilient member 88 configured to protect sensor 58 from compressive forces during torquing of fasteners 86.

Connector guard 62 may be connected to body 56 and may be configured to protect a connector 89 of sensor 58 from impact. Specifically, connector guard 62 may include an outer shell 90 and an internal cavity 92, within which connector 89 is disposed. Connector guard 62 may be connected to body 56 via fasteners (not shown), via an adhesive (not shown), or in any other manner known in the art.

INDUSTRIAL APPLICABILITY

The disclosed hydraulic cylinder may be applicable to any apparatus where mechanical impact protection between a piston within the hydraulic cylinder and an end structure of the hydraulic cylinder is important. In particular, the disclosed hydraulic cylinder 16 may be used in conjunction with mechanically, hydraulically, or electronically actuated hydraulic valves that control fluid flow to or from a hydraulic cylinder. In the disclosed embodiment, hydraulic cylinder 16 may, in conjunction with piston assembly 20 and valve plunger 38, provide a snubbing-type valve for mechanically preventing impact between piston assembly 20 and cap assembly 22, while allowing sensor 58, which is internally disposed within hydraulic cylinder 16, to determine a position of piston assembly 20 relative to tube 18 for purposes other than cushioning an end of a piston stroke. The snubbing-type valve within hydraulic cylinder 16 may be used as a primary means to cushion the end of a piston stroke within hydraulic cylinder 16 or may be used as a backup system that is secondary to a position-based electronically-controlled hydraulic valve system using sensor 58. The operation of hydraulic cylinder 16 will now be explained.

Fluid may be introduced into tube 18 between piston assembly 20 and cap assembly 22 while draining fluid away from second hydraulic surface 44 to create a pressure differential across piston 32 that causes piston assembly 20 to move away from cap assembly 22 to increase the effective length of hydraulic cylinder 16. Fluid may be drained from between piston assembly 20 and cap assembly 22, while directing pressurized fluid to second hydraulic surface 44 of piston 32 to retract piston assembly 20 back within tube 18 to decrease the effective length of hydraulic cylinder 16. This fluid may be introduced into and drained out of tube 18, between piston assembly 20 and cap assembly 22 via fluid port 74 and passageway 76. To prevent piston assembly 20 from impacting cap assembly 22 during retraction, the fluid flow out of tube 18 through passageway 76 may be progressively restricted or "snubbed" by tapered portion 54 of valve plunger 38 as piston assembly 20 nears cap assembly 22. Specifically, as tapered portion 54 of valve plunger 38 enters passageway 76 during movement of piston assembly 20 towards cap assembly 22, the area available for fluid flow out of tube 18 may be gradually reduced. This reduction in available flow area creates a buildup in pressure between piston assembly 20 and cap assembly 22 that gradually slows and eventually stops movement of piston assembly 20 relative to cap assembly 22. In this manner, impact between piston assembly 20 and cap assembly 22 may be prevented. It is contemplated that an arrangement (not shown) similar to valve plunger 38 and cap assembly 22 may be located towards the end of hydraulic cylinder 16 having eye member 24 to similarly cushion the end of a length increasing stroke of piston assembly 20 within cylinder 16.

It will be apparent to those skilled in the art that various modifications and variations can be made to the disclosed hydraulic cylinder. Other embodiments will be apparent to those skilled in the art from consideration of the specification and practice of the disclosed particulate trap. It is intended that the specification and examples be considered as exemplary only, with a true scope being indicated by the following claims and their equivalents.

What is claimed is:

1. A hydraulic cylinder, comprising:

a tube having a first end and a second end;

a piston assembly movably disposed within the tube and configured to move between the first end and the second end of the tube;

a valve plunger connected to the piston assembly; and a cap assembly connected to the first end of the tube to close off the first end of the tube, the cap assembly having a fluid passageway, wherein the valve plunger is configured to progressively restrict fluid flow through the fluid passageway as the piston assembly approaches the first end of the tube, wherein the cap assembly further includes:

a cap bore, and a sensor disposed within the cap bore; and a magnet coupled to the piston assembly and configured to interact with the sensor.

2. The hydraulic cylinder of claim 1, wherein the valve plunger includes and axial bore and is fixedly connected to the piston assembly.

3. The hydraulic cylinder of claim 1, wherein the sensor includes a position sensor.

4. The hydraulic cylinder of claim 1, further including a cap member configured to retain and position a portion of the sensor within the cap bore.

5. The hydraulic cylinder of claim 1, wherein the piston assembly includes:

a piston; and a piston rod connected to the piston, wherein at least one of the piston and the piston rod includes an axial bore configured to receive the valve plunger.

6. The hydraulic cylinder of claim 1, further including at least one port in communication with the fluid passageway and configured to allow fluid into and out of the hydraulic cylinder.

7. The hydraulic cylinder of claim 1, wherein the piston assembly includes:

a piston; and a piston rod connected to the piston, the piston rod having an axial bore extending at least a portion of the length of the piston rod and aligned with an axial bore in the valve plunger.

8. The hydraulic cylinder of claim 7, further including an axially arranged sensor member disposed within the axial bore of the piston rod and the axial bore of the valve plunger.

9. A method of operating a hydraulic cylinder, comprising:

moving a piston assembly within a tube between first and second positions;

progressively restricting a flow of fluid through a fluid passageway in a cap assembly connected to the tube with a valve plunger as the piston assembly nears the first position, the valve plunger being connected to the piston assembly and having an axial bore; and moving the valve plunger relative to a sensor member disposed within the axial bore of the valve plunger.

10. The method of claim 9, further including measuring a position of the piston assembly relative to the cap assembly.

11. The method of claim 10, wherein the measuring of the position of the piston assembly is accomplished by causing the sensor to interact with a sensor component coupled to the piston assembly.

12. The method of claim 11, wherein the interacting between the sensor and the sensor component is accomplished via the axial bore in the valve plunger and an axial bore in the piston assembly.

13. The method of claim 9, wherein the piston assembly includes a piston fixedly connected to a piston rod, the valve plunger being disposed within an axial bore located in at least one of the piston and the piston rod.

14. The method of claim 9, further including directing the fluid into and out of the hydraulic cylinder via the at least one port located in the cap assembly.

15. A work machine, comprising:

a frame;

a work implement; and a hydraulic cylinder operatively connected to the frame and configured to assist in moving the work implement, the hydraulic cylinder including:

a tube;

a piston assembly movably disposed within the tube and configured to move between first and second positions;

a valve plunger connected to the piston assembly and having an axial bore; and a cap assembly connected to the tube to close off an end of the tube, the cap assembly having a fluid passageway, wherein the valve plunger is configured to progressively restrict fluid flow through the fluid passageway as the piston assembly approaches the first position, wherein the cap assembly further includes:

a cap bore axially aligned with the tube; and a position sensor disposed within the cap bore, and wherein the piston assembly includes:

a piston;

a piston rod connected to the piston, the piston rod having an axial bore extending at least a portion of the length of the piston rod and aligned with the axial bore in the valve plunger; and an annular sensor component coupled to the piston rod and configured to interact with the sensor.

16. The work machine of claim 15, wherein the valve plunger is fixedly connected to the piston assembly.

17. The work machine of claim 15, wherein the hydraulic cylinder further includes a cap member configured to retain and position the position sensor within the cap bore.

18. The work machine of claim 15, wherein the position sensor includes an axially extending sensor member disposed within the axial bore of the piston rod and the axial bore of the valve plunger.

19. The work machine of claim 15, wherein the piston assembly includes:

a piston; and a piston rod connected to the piston, wherein at least one of the piston and the piston rod includes an axial bore configured to receive the valve plunger.

20. The work machine of claim 15, wherein the hydraulic cylinder further includes a port in communication with the fluid passageway and configured to allow a flow of fluid into and out of the hydraulic cylinder.

21. A hydraulic cylinder, comprising:

a tube having a first end and a second end;

a piston assembly movably disposed within the tube and configured to move between the first end and the second end of the tube;

a valve member disposed within the hydraulic cylinder and configured to progressively restrict a fluid flow out of the tube as the piston assembly approaches the first end of the tube;

a cap assembly connected to the first end of the tube to close off the first end of the tube, the cap assembly including a cap bore; and a position sensor disposed within the cap bore and configured to determine a position of the piston assembly, the valve member including a valve plunger having an axial bore, and a portion of the position sensor extends within and through the axial bore.

22. The hydraulic cylinder of claim 21, further including a cap member configured to retain and position a portion of the position sensor within the cap bore.

23. A hydraulic cylinder, comprising:

a tube having a first end and a second end;

a piston assembly movably disposed within the tube and configured to move between the first end and the second end of the tube;

a valve member disposed within the hydraulic cylinder and configured to progressively restrict a fluid flow out of the tube as the piston assembly approaches the first end of the tube;

a cap assembly connected to the first end of the tube to close off the first end of the tube, the cap assembly including a cap bore; and a position sensor disposed within the cap bore and configured to determine a position of the piston assembly, wherein the piston assembly includes a magnet coupled to the piston assembly and configured to interact with the position sensor.

24. The hydraulic cylinder of claim 23, wherein the valve member is coupled to the piston assembly.

25. The hydraulic cylinder of claim 23, wherein the piston assembly includes an axial bore and the valve member is arranged within the axial bore of the piston assembly.

26. The hydraulic cylinder of claim 23, wherein the valve member is fixedly attached to the piston assembly.

* * * * *